US006997770B2

(12) United States Patent
Lapointe

(10) Patent No.: US 6,997,770 B2
(45) Date of Patent: Feb. 14, 2006

(54) AIR PRESSURE PROJECTILE LAUNCHER

(76) Inventor: Brian Lapointe, 25 Cottage Dr., West Yarmouth, MA (US) 02673

( * ) Notice: Subject to any disclaimer, the term of this patent is extended or adjusted under 35 U.S.C. 154(b) by 0 days.

(21) Appl. No.: 10/904,104

(22) Filed: Oct. 22, 2004

(65) Prior Publication Data

US 2005/0183710 A1 Aug. 25, 2005

Related U.S. Application Data

(63) Continuation-in-part of application No. 10/708,300, filed on Feb. 23, 2004, now abandoned.

(51) Int. Cl.
*A63H 27/127* (2006.01)

(52) U.S. Cl. ..... 446/39; 446/231; 124/66

(58) Field of Classification Search ..... 446/34, 446/39, 51, 52, 54, 230, 231; 124/56, 63, 124/64, 66, 67

See application file for complete search history.

(56) References Cited

U.S. PATENT DOCUMENTS

| | | | | |
|---|---|---|---|---|
| 2,751,711 | A * | 6/1956 | Greenwood | 446/399 |
| 2,923,089 | A * | 2/1960 | Fissel | 446/231 |
| 3,077,876 | A * | 2/1963 | Richter | 124/65 |
| 3,191,342 | A * | 6/1965 | Chalmers | 446/231 |
| 3,949,518 | A * | 4/1976 | Lenza | 446/186 |
| 6,568,985 | B1 * | 5/2003 | Binkley | 446/176 |

OTHER PUBLICATIONS

Boss Bow-Bow and Arrow. 2004.*

* cited by examiner

*Primary Examiner*—Bena Miller

(57) ABSTRACT

An air pressure projectile launcher toy comprising at lease one soft foam projectile and a telescopic tube assembly, adapted on one end for releasably securing a projectile, and capable of generating a high speed compressed air stream, which is buffered by a large available air volume, intended to accelerate lightweight foam projectiles without generating an undesirable shock wave, caused by the rapid build-up of high internal pressures, thereby making it possible for children to launch safe foam projectiles with less effort and increased accuracy.

1 Claim, 2 Drawing Sheets

Fig. 1
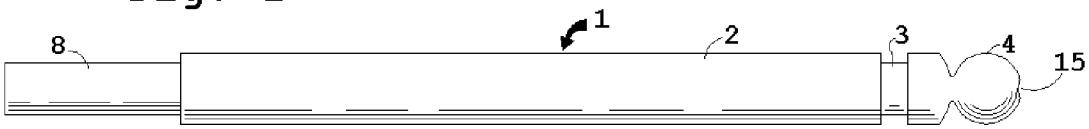
Fig. 2
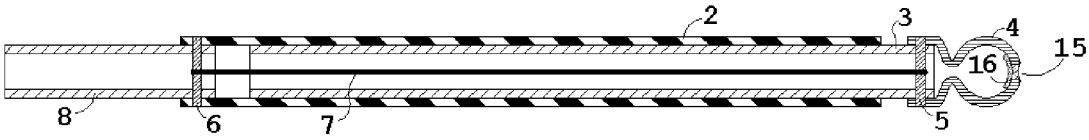
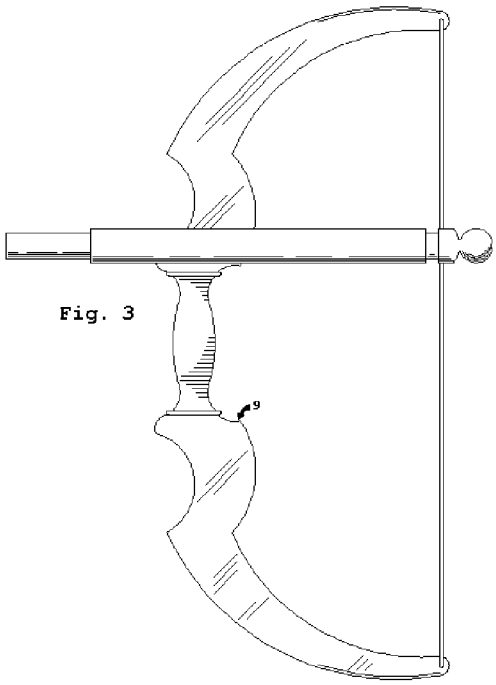
Fig. 3

AIR PRESSURE PROJECTILE LAUNCHER

This application is a CIP of Ser. No. 10/708,300, filed Feb. 23, 2004 now abandoned.

BACKGROUND OF INVENTION

1. Field of the Invention

The present invention relates generally to an air pressure launching mechanism, which is easier to use and less expensive to manufacture than similar devices that are currently available to the public. Particularly this invention addresses the problems that children experience when attempting to launch a projectile accurately and quickly.

2. Description of the Prior Art

Various types of devices have been created and marketed over the years, in an attempt to offer children some means of firing a safe projectile easily and accurately. While it is true that most, if not all, launching systems do successfully accelerate and convey a projectile across a distance, there are significant deficiencies in these contrivances relating to safety, control and the ease of use by children.

The most prevalent means, used for storing and releasing the energy required to launch a projectile, is the metal coil spring. U.S. Pat. Nos. 3,430,620 and 5,653,215 disclose devices, whereby the user is required to elongate an internal steel coil spring by drawing back on an external handle. While these metal springs add undesirable weight to items that are typically hand held by the user, the most significant problems arise from the fact that metal springs store and release energy in a very non-linear fashion. This fact makes the step of storing energy, by elongating a spring, an exercise which becomes increasingly more difficult as the user approaches completion. Not only do many children experience great difficulty with this process, but a risk of injury must be seriously considered if the user looses control of the device, before the step of storing energy is completed.

In another example, U.S. Pat. Nos. 5,224,464 and 5,242,323 disclose nearly identical mechanisms for launching projectiles, both of which specify the use of coil springs as an energy storage means. In both disclosures, the user is required to compress an internal coil spring by pulling on an external handle. The resulting compressed spring releases stored energy in a very non-linear fashion. The initial release of energy is explosive and abrupt, resulting in a number of undesirable performance issues, including the concerns of added weight and safety previously noted.

U.S. Pat. No. 1,541,579 discloses a far more linear, storage-and-release-of-energy means, for launching a projectile. By making use of an externally mounted, unguarded rubber band, however, the device exposes children to a variety of potential injuries resulting from pinch points and the failure to prevent the launching of various dangerous articles such as rocks, pencils and the like.

The need exists for an improved projectile launching device, which is both safe and simple for children to operate. The need also exists for a safe projectile launcher, which is simple, lightweight, and cost efficient to manufacture; one whose means for storing and releasing energy allows the user to rapidly as well as accurately fire projectiles, and thereby provide hours of safe amusement and satisfaction.

SUMMARY OF INVENTION

This invention is concerned, with providing a lightweight projectile launching device, that is safer and easier for children to operate; utilizing an energy storage means, which allows for the more rapid firing of projectiles, with greater accuracy.

It is therefore one object of this invention, to provide a lightweight air pressure projectile launcher, which incorporates a simple cylindrical pump mechanism. Using a pair of telescopic plastic tubes, a simple pump mechanism can be constructed, by inserting the smaller diameter telescopic tube partially into the larger diameter telescopic tube and sealing the exposed end of the smaller diameter telescopic tube. The resulting pump apparatus has no need of any internal seal between the telescopic tubes, since it can operate at a speed, which is high enough to prevent any significant loss of air due to leakage.

Another object of this invention is to provide a projectile launching device, that addresses the problems experienced by children, who operate projectile launchers, where a metal spring is employed as an energy storage means, which is usually the case among projectile launchers, as shown in the prior art. By using an elastic, natural or synthetic rubber cord, as an energy storage means, a projectile launching device, which is easier to operate, can be constructed. Since an elastic cord stores energy by applying relatively uniform increments of force as it is stretched, a projectile launcher, which incorporates an elastic cord as an energy storage means, operates more smoothly than those using metal springs. A child's ability to operate the launch mechanism rapidly, while maintaining accuracy is improved, because the more linear application of force to the launch mechanism while storing energy, makes it easier for a child to remain motionless as the mechanism and stored energy are released.

Other objects and advantages of this invention will become apparent from a consideration of the drawings and ensuing description.

BRIEF DESCRIPTION OF DRAWINGS

FIG. 1 is a side view illustrating the simplest embodiment of the invention.

FIG. 2 is a cross-sectional view of the simplest embodiment of the invention.

FIG. 3 is a side view illustrating one embodiment of a toy bow in accordance with the invention.

DETAILED DESCRIPTION

Figure 5:
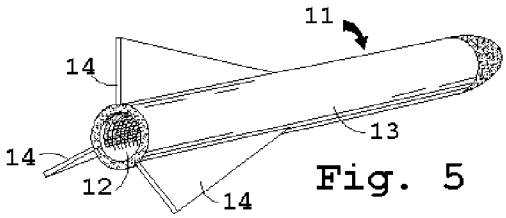
FIG. 5 is a perspective view illustrating the preferred embodiment of a projectile.

In the preferred embodiment, FIG. 1 discloses a side view of air pressure projectile launcher mechanism 1, in its simplest form. Projectile 11, shown in FIG. 5, can be loaded onto air pressure projectile launcher mechanism 1, by wholly inserting end tube 8 into bore 12 of projectile 11. With projectile 11 loaded, barrel tube 2, of air pressure projectile launcher mechanism 1 can be held easily in one hand, while piston handle 4 is pulled back and released to launch projectile 11.

The successful launching of projectile 11 is only possible, if several aspects of both air pressure projectile launcher mechanism 1 and projectile 11 are manufactured within relatively close tolerances following specific requirements. In the preferred embodiment, projectile 11 is constructed from lightweight resilient materials. Projectile body 13 is a solid round extrusion made from two to four pound per cubic foot density foamed plastic polyethylene with five percent ethylene vinyl acetate added for increased elasticity. Any foamed plastic material having a density between two and eight pounds per cubic foot is sufficient for rear wings 14, which are attached to projectile body 13 by heat welding or adhesive. A bore 12 is drilled axially in body 13, to a depth just slightly greater than the exposed length of end tube 8 of air pressure projectile launcher mechanism 1, at the end where rear wings 14 are attached. The diameter of bore 12 must not exceed the outside diameter of end tube 8 and should preferably be between one and twenty thousandths of an inch smaller than the diameter of end tube 8, in order to create an appropriate snug fit when end tube 8 is inserted into bore 12.

Figure 4:
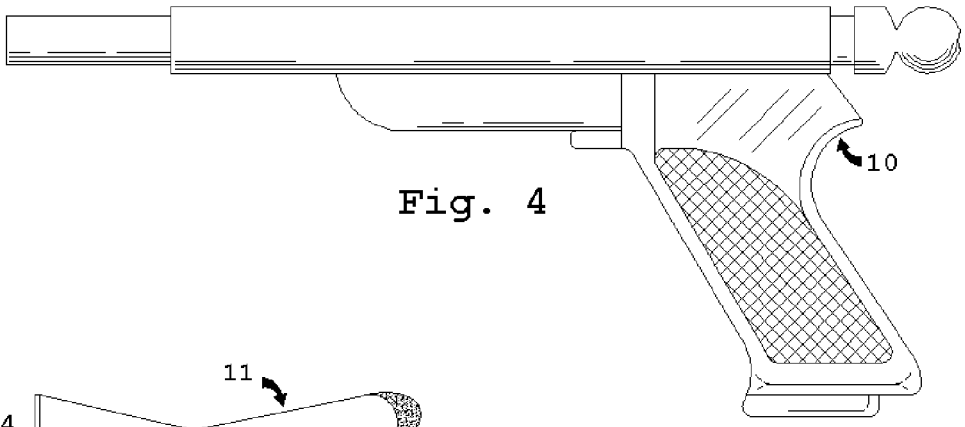
FIG. 4 is a side view illustrating one embodiment of a toy pistol in accordance with the invention.

In the preferred embodiment, air pressure projectile launcher mechanism 1 is constructed from injection molded styrene plastic pieces, so that all of the individual components will be strong and lightweight; true and without distortion or inconsistency. Normal production tolerances of plastic injection molding, as well as its high degree of cost efficiency make this a desirable manufacturing method for air pressure projectile launcher mechanism 1, as well as other embodiments, such as, a bow toy illustrated in FIG. 3 and a pistol toy illustrated in FIG. 4.

A more detailed consideration of the construction, of air pressure projectile launcher 1, reveals how barrel tube 2 provides its basic foundation. End tube 8, whose outside diameter is just slightly less than the inside diameter of barrel tube 2, is permanently attached, by partially inserting end tube 8 into one end of barrel tube 2, and gluing or sonic welding, such that the inside diameter of barrel tube 2 overlaps the outside diameter of end tube 8 to provide a strong and permanent union. Fixed steel pin 6, whose length is equal to the outside diameter of barrel tube 2, and whose diameter is large enough to withstand five times the force which can be applied by elastic cord 7 without distorting, is inserted, by drilling through the overlap joint between end tube 8 and barrel tube 2 and press-fitting into place. Piston tube 3 has, what is commonly referred to in the plastics industry as, a telescopic fit with barrel tube 2. Piston tube 3 has an outside diameter, which is between one and fifteen thousandths of an inch smaller, than the inside diameter of barrel tube 2. At one end of piston tube 3, ball handle 4, whose inside diameter at its forward open end is just slightly greater than the outside diameter of piston tube 3, is permanently attached by gluing or sonic welding, such that the outside diameter of piston tube 3 overlaps with the inside diameter of the forward, open end of ball handle 4 providing a strong and permanent union. A one way flap valve 16, at the back end of ball handle 4, is constructed of soft flexible material such as low durometer rubber sheet, and flexes as ball handle 4 is pulled rearward, because of air entering through hole 15, allowing air pressure projectile launcher 1 to fill with air rapidly. Movable steel pin 5, whose length is equal to the outside diameter of the open end of ball handle 4, and whose diameter is large enough to withstand five times the force which can be applied by elastic cord 7 without distorting, is inserted, by drilling through the overlap joint between piston tube 3 and ball handle 4 and press-fitting into place. Elastic cord 7 is composed of an elastic rubber material, which is covered by a braid of synthetic thread; commonly referred to as braided elastic cord, shock cord or bungee cord. The braid should be applied so as to prevent elastic cord 7 from elongating more than one hundred percent. One end of elastic cord 7 is permanently attached to fixed steel pin 6 while the other end of elastic cord 7 is permanently attached to movable steel pin 5. When attached at both ends, elastic cord 7 is under tension, elongated by approximately twenty percent. Therefore, when air pressure projectile launcher 1 is operated, elastic cord 7 can only be elongated by eighty percent, before being stopped by the overlying braid. This ensures that piston tube 3 cannot be completely removed from within barrel tube 2 and in fact remains inserted in barrel tube 2 so there is sufficient overlapping by barrel tube 2 to prevent a misalignment, which would interfere with the smooth launching of projectile 11, when ball handle 4 was released.

It should be noted, that the addition of any kind of sealing element, mounted on the end of piston tube 3 where it resides within barrel tube 2, as is typical, and is usually essential in air pressure projectile launchers, would have a negative effect on the operation of air pressure projectile launcher 1. In one instance, if an air tight sealing component was introduced between the outside diameter of piston tube 3 and the inside diameter of barrel tube 2, the movement of piston tube 3 would be slower and the resulting launch of projectile 11 less than optimal, or require that the user be strong enough to store a greater amount of energy to achieve optimal performance. In another instance, if a sealing component, which obstructed the open end of piston tube 3, while creating an air tight seal with the inside diameter of barrel tube 2, were incorporated into air pressure projectile launcher 1, as is common in the design of air pressure projectile launchers, the build-up of pressure inside bore 12 of projectile 11, during launch, could be extreme enough to cause a rupture in body 13 at some point along the side wall of bore 12. The fact that piston tube 3 is left open on an end, which end remains inserted into barrel tube 2, allows for a reservoir of compressible air to be always present within air pressure projectile launcher 1, to function as a buffer against the build-up of very high pressures during launch. The compression of a much larger volume of air within air pressure projectile launcher 1, than typically occurs in air pressure projectile launchers, results in an increase in the medium available for the transferring of stored energy from elastic cord 7 to projectile 11, thus reducing the transfer of shock to both the hands of the user and projectile 11, which shock would otherwise reduce accuracy.

What is claimed is:

1. An air pressure projectile launcher toy set comprising: an elongated soft foam projectile, having a cylindrical body composed of resilient soft foamed plastic material; said body having a front portion and a rear portion; said rear portion having at least two lightweight foam plastic wings for controlling the orientation of said projectile during flight; said body having an axial bore in said rear portion; an outer tube and an inner tube assembly; said assembly having a front portion and a rear portion; said inner tube having an outside diameter between one and twenty thousandths of an inch less than the inside diameter of said outer tube; said outer tube adapted at said front portion for releasably securing said projectile thereto; said inner tube slidably received in said outer tube such that said inner tube has an exposed portion at the rear of said assembly; a handle permanently secured to said exposed portion of said inner tube; said handle incorporating a one way flap valve rendering said inner tube axially permeable when moved in a rearward direction and axially impermeable when moved in a forward direction; a biasing means in said assembly biasing said inner tube in said forward direction; said inner tube manually movable in said rearward direction; said assembly capably of generating a compressed air stream in said forward direction; said assembly capable of functioning as a projectile launcher.

* * * * *